US009437202B2

(12) United States Patent
Näslund et al.

(10) Patent No.: US 9,437,202 B2
(45) Date of Patent: Sep. 6, 2016

(54) BANDWIDTH EXTENSION OF HARMONIC AUDIO SIGNAL

(71) Applicant: Telefonaktiebolaget L M Ericsson (publ), Stockholm (SE)

(72) Inventors: Sebastian Näslund, Solna (SE); Volodya Grancharov, Solna (SE); Tomas Jansson Toftgård, Uppsala (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 128 days.

(21) Appl. No.: 14/388,052

(22) PCT Filed: Dec. 21, 2012

(86) PCT No.: PCT/SE2012/051470

§ 371 (c)(1),
(2) Date: Sep. 25, 2014

(87) PCT Pub. No.: WO2013/147668

PCT Pub. Date: Oct. 3, 2013

(65) Prior Publication Data

US 2015/0088527 A1 Mar. 26, 2015

Related U.S. Application Data

(60) Provisional application No. 61/617,175, filed on Mar. 29, 2012.

(51) Int. Cl.

| | |
|---|---|
| ***G10L 21/00*** | (2013.01) |
| ***G10L 19/02*** | (2013.01) |
| ***G10L 21/0388*** | (2013.01) |

(52) U.S. Cl.

CPC ..... *G10L 19/02* (2013.01); *G10L 21/0388* (2013.01)

(58) Field of Classification Search

CPC ..... G10L 19/0212; G10L 21/038; G10L 19/0017; G10L 19/008; G10L 19/02; G10L 19/032; G10L 19/173; G10L 19/18; G10L 19/002; G10L 19/0208; G10L 19/022; G10L 19/028; G10L 19/035; G10L 19/12; G10L 19/24

USPC ..... 704/500–502, 230, 219, 205, 203, 704/200.1, 201, 226–228, 270.1, 241, 225

See application file for complete search history.

(56) References Cited

U.S. PATENT DOCUMENTS 8,532,998 B2 * 9/2013 Gao ..... G10L 21/038 704/200
8,688,441 B2 * 4/2014 Ramabadran ..... G10L 21/038 704/200

(Continued)

FOREIGN PATENT DOCUMENTS

WO WO 00/45379 A2 8/2000
WO WO 2012/017621 A1 2/2012

OTHER PUBLICATIONS

International Search Report, PCT Application No. PCT/SE2012/051470, Mar. 22, 2013.

(Continued)

*Primary Examiner* — Vijay B Chawan
(74) *Attorney, Agent, or Firm* — Myers Bigel & Sibley, P.A.

(57) ABSTRACT

Methods and arrangements in a codec for supporting bandwidth extension, BWE, of an harmonic audio signal. The method in the decoder part of the codec comprises receiving a plurality of gain values associated with a frequency band b and a number of adjacent frequency bands of band b. The method further comprises determining whether a reconstructed corresponding frequency band b' comprises a spectral peak. When the band b' comprises a spectral peak, a gain value associated with the band b' is set to a first value based on the received plurality of gain values; and otherwise the gain value is set to a second value based on the received plurality of gain values. The suggested technology enables bringing gain values into agreement with peak positions in a bandwidth extended frequency region.

12 Claims, 8 Drawing Sheets

(56) References Cited

U.S. PATENT DOCUMENTS 8,856,011 B2 * 10/2014 Sverrisson ..... G10L 21/038 704/500
9,293,149 B2 * 3/2016 Bayer ..... G10L 19/002 704/500
2007/0165869 A1 * 7/2007 Ojanpera ..... G10L 19/008 381/23
2010/0063803 A1 * 3/2010 Gao ..... G10L 21/0364 704/205
2010/0063827 A1 * 3/2010 Gao ..... G10L 21/038 704/500
2010/0198587 A1 * 8/2010 Ramabadran ..... G10L 19/06 704/205
2010/0280834 A1 * 11/2010 Tsushima ..... G10L 19/0208 704/500
2011/0202353 A1 * 8/2011 Neuendorf ..... G10L 19/20 704/500
2011/0238425 A1 * 9/2011 Neuendorf ..... G10L 19/008 704/500
2012/0136670 A1 * 5/2012 Ishikawa ..... G10L 21/038 704/500
2012/0239388 A1 * 9/2012 Sverrisson ..... G10L 21/038 704/205
2012/0278085 A1 * 11/2012 Naslund ..... G10L 19/02 704/500
2012/0281859 A1 * 11/2012 Villemoes ..... G10L 21/038 381/98
2013/0066640 A1 * 3/2013 Grill ..... G10L 19/18 704/500
2014/0236581 A1 * 8/2014 Lee ..... G10L 19/032 704/203
2014/0257827 A1 * 9/2014 Norvell ..... G10L 21/038 704/500
2015/0110292 A1 * 4/2015 Nagel ..... G10L 21/0388 381/98
2015/0248894 A1 * 9/2015 Ishikawa ..... G10L 21/038 704/500
2015/0287417 A1 * 10/2015 Disch ..... G10L 19/03 704/500

OTHER PUBLICATIONS

Written Opinion of the International Searching Report, PCT Application No. PCT/SE2012/051470, Mar. 22, 2013.

International Preliminary Report on Patentability, PCT Application No. PCT/SE2012/051470, Mar. 24, 2014.

* cited by examiner

BANDWIDTH EXTENSION OF HARMONIC AUDIO SIGNAL

CROSS REFERENCE TO RELATED APPLICATIONS

This application is a 35 U.S.C. §371 national stage application of PCT International Application No. PCT/SE2012/051470, filed on Dec. 21, 2012, which itself claims priority to U.S. provisional Patent Application No. 61/617,175, filed Mar. 29, 2012, the disclosure and content of both of which are incorporated by reference herein in their entirety. The above-referenced PCT International Application was published in the English language as International Publication No. WO 2013/147668 A1 on 3 Oct. 2013.

TECHNICAL FIELD

The suggested technology relates to the encoding and decoding of audio signals, and especially to supporting BandWidth Extension (BWE) of harmonic audio signals.

BACKGROUND

Transform based coding is the most commonly used scheme in audio compression/transmission systems of today. The major steps in such a scheme is to first convert a short block of the signal waveform into the frequency domain by a suitable transform, e.g., DFT (Discrete Fourier transform), DCT (Discrete Cosine Transform), or MDCT (Modified Discrete Cosine Transform). The transform coefficients are then quantized, transmitted or stored and later used to reconstruct the audio signal. This approach works well for general audio signals, but requires a high enough bitrate to create a sufficiently good representation of the transform coefficients. Below, a high-level overview of such transform domain coding schemes will be given.

On a block-by-block basis, the waveform to be encoded is transformed to the frequency domain. One commonly used transform used for this purpose is the so-called Modified Discrete Cosine Transform (MDCT). The thus obtained frequency domain transform vector is split into spectrum envelope (slowly varying energy) and spectrum residual. The spectrum residual is obtained by normalizing the obtained frequency domain vector with said spectrum envelope. The spectrum envelope is quantized, and quantization indices are transmitted to the decoder. Next, the quantized spectrum envelope is used as an input to a bit distribution algorithm, and bits for encoding of the residual vectors are distributed based on the characteristics of the spectrum envelope. As an outcome of this step, a certain number of bits are assigned to different parts of the residual (residual vectors or "sub-vectors"). Some residual vectors do not receive any bits and have to be noise-filled or bandwidth-extended. Typically, the coding of residual vectors is a two step procedure; first, the amplitudes of the vector elements are coded, and next the sign (which should not be confused with "phase", which is associated with e.g. Fourier transforms) of the non-zero elements is encoded. Quantization indices for the residual's amplitude and sign are transmitted to the decoder, where residual and spectrum envelope are combined, and finally transformed back to time domain.

The capacity in telecommunication networks in continuously increasing. However, despite the increased capacity, there is still a strong drive to limit the required bandwidth per communication channel. In mobile networks, smaller transmission bandwidths for each call yields lower power consumption in both the mobile device and the base station serving the device. This translates to energy and cost saving for the mobile operator, while the end user will experience prolonged battery life and increased talk-time. Further, the less bandwidth that is consumed per user, the more users could be served (in parallel) by the mobile network.

One way of improving the quality of an audio signal, which is to be conveyed using a low or moderate bitrate, is to focus the available bits to accurately represent the lower frequencies in the audio signal. Then, BWE techniques may be used to model the higher frequencies based on the lower frequencies, which only requires a low number of bits. The background for these techniques is that the sensitivity of the human auditory system is frequency dependent. In particular, the human auditory system, i.e. our hearing, is less accurate for higher frequencies.

In a typical frequency-domain BWE scheme, high-frequency transform coefficients are grouped in bands. A gain (energy) for each band is calculated, quantized, and transmitted (to a decoder of the signal). At the decoder, a flipped or translated and energy normalized version of the received low-frequency coefficients is scaled with the high-frequency gains. In this way the BWE is not completely "blind," since at least the spectral energy resembles that of the high-frequency bands of the target signal.

However, BWE of certain audio signals may result in audio signals comprising defects, which are annoying to a listener.

SUMMARY

Herein, a technology is suggested, for supporting and improving BWE of harmonic audio signals.

According to a first aspect, a method is suggested in a transform audio decoder. The method being for supporting bandwidth extension, BWE, of a harmonic audio signal. The suggested method may comprise reception of a plurality of gain values associated with a frequency band b and a number of adjacent frequency bands of band b. The suggested method further comprises determining of whether a reconstructed corresponding band b' of a bandwidth extended frequency region comprises a spectral peak. Further, if the band comprises at least one spectral peak, the method comprises setting the gain value $G_b$ associated with band b' to a first valuebased on the received plurality of gain values. If the band does not comprise any spectral peak, the method comprises setting the gain value $G_b$ associated with band b' to a second value based on the received plurality of gain values. Thus, the bringing of gain values into agreement with peak positions in the bandwidth extended part of the spectrum is enabled.

Further, the method may comprise receiving a parameter or coefficient $\alpha$ reflecting a relation between the peak energy and the noise-floor energy of at least a section of the high frequency part of an original signal. The method may further comprise mixing transform coefficients of a corresponding reconstructed high frequency section with noise, based on the received coefficient $\alpha$. Thus, reconstruction/emulation of the noise characteristics of the high frequency part of the original signal is enabled.

According to a second aspect, a transform audio decoder, or codec, is suggested, for supporting bandwidth extension, BWE, of a harmonic audio signal. The transform audio codec may comprise functional units adapted to perform the actions described above. Further, a transform audio encoder, or codec is suggested, comprising functional units adapted to derive and provide one or more parameters enabling the noise mixing described herein, when provided to a transform audio decoder.

According to a third aspect, a user terminal is suggested, which comprises a transform audio codec according to the second aspect. The user terminal may be a device such as a mobile terminal, a tablet, a computer, a smart phone, or the like.

BRIEF DESCRIPTION OF THE DRAWINGS

The suggested technology will now be described in more detail by means of exemplifying embodiments and with reference to the accompanying drawings, in which.

DETAILED DESCRIPTION

Bandwidth extension of harmonic audio signals is associated with some problems as indicated above. In a decoder, when the low-band, i.e. the part of the frequency band which has been encoded, conveyed and decoded, is flipped or translated to form the high-band, it is not certain that the spectral peaks will end up in the same bands as the spectral peaks in the original signal, or "true" high-band. A spectral peak from the low-band might end up in a band where the original signal did not have a peak. It might also be the other way around, i.e. that a part of the low-band signal that does not have a peak ends up (after flipping or translation) in a band where the original signal has a peak. An example of a harmonic spectrum is provided in FIG. 1, and an illustration of the BWE concept is provided in FIG. 2, which will be further described below.

The effect described above might cause severe quality degradation on signals with predominantly harmonic content. The reason is that this mismatch between peak and gain positions will cause either unnecessary peak attenuation, or amplification of low-energy spectral coefficients between two spectral peaks.

The herein described solution relates to a novel method to control the band gains in a bandwidth extended region based on information about the positions of the peaks. Further, the herein suggested BWE algorithm may control the 'spectral peaks to noise-floor ratio', by means of transmitted noise-mix levels. This results in BWE which preserves the amount of structure in the extended high-frequencies.

Figure 1:
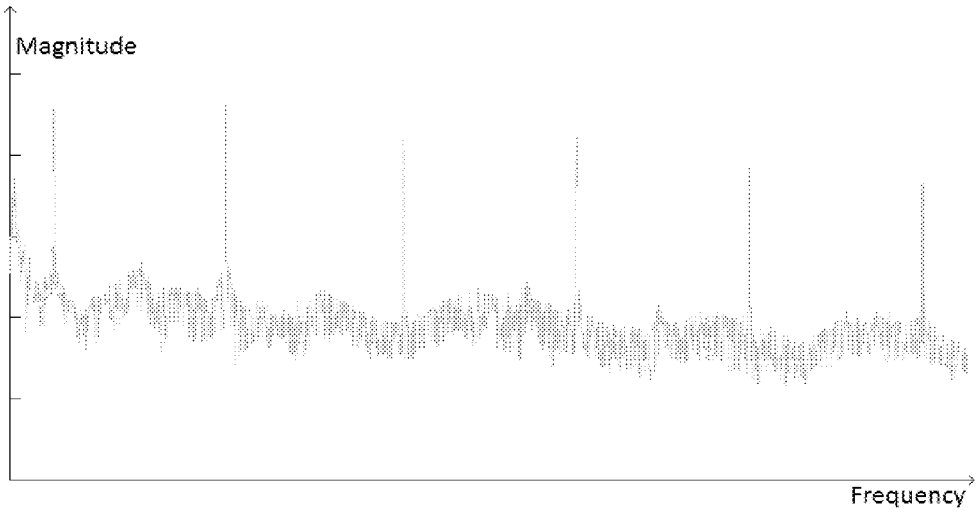
FIG. 1 shows a harmonic audio spectrum, i.e. the spectrum of an harmonic audio signal. This type of spectrum is typical for e.g., single instrument sounds, vocal sounds, etc.

The solution described herein is suitable for use with harmonic audio signals. FIG. 1 shows a frequency spectrum of a harmonic audio signal, which may also be denoted a harmonic spectra. As can be seen from the figure, the spectrum comprises peaks. This type of spectrum is typical for e.g. sounds from a single instrument, such as a flute, or vocal sounds, etc.

Herein, two parts of a spectrum of a harmonic audio signal will be discussed. One lower part comprising lower frequencies, where "lower" indicates lower than the part which will be subjected to bandwidth extension; and one upper part comprising higher frequencies, i.e. higher than the lower part. Expressions like "the lower part" or "the low/lower frequencies" used herein refer to the part of the harmonic audio spectrum below a BWE crossover frequency (cf. FIG. 2). Analogously, expressions like the upper part", or the high/higher frequencies" refer to the part of the harmonic audio spectrum above a BWE crossover frequency (cf. FIG. 2).

Figure 2:
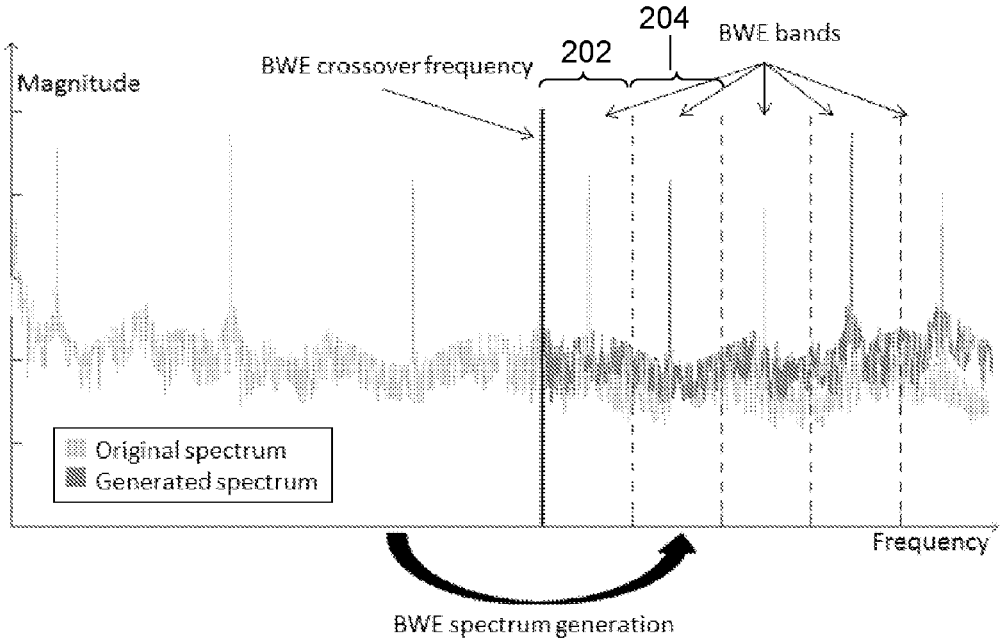
FIG. 2 shows a bandwidth extended harmonic audio spectrum.

FIG. 2 shows a spectrum of a harmonic audio signal. Here, the two parts discussed below can be seen as the lower part to the left of the BWE crossover frequency and the upper part to the right of the BWE crossover frequency. In FIG. 2, the original spectrum, i.e. the spectrum of the original audio signal (as seen at the encoder side) is illustrated in light gray. The bandwidth extended part of the spectrum is illustrated in dark/darker gray. The bandwidth extended part of the spectrum is not encoded by the encoder, but is recreated at the decoder by use of the received lower part of the spectrum, as previously described. In FIG. 2, for reasons of comparison, both the original (light-gray) spectrum and the BWE (dark-gray) spectrum can be seen for the higher frequencies. The original spectrum for the higher frequencies is unknown to the decoder, with the exception of a gain value for each BWE band (or high frequency band). The BWE bands are separated by dashed lines in FIG. 2.

Figure 3A:
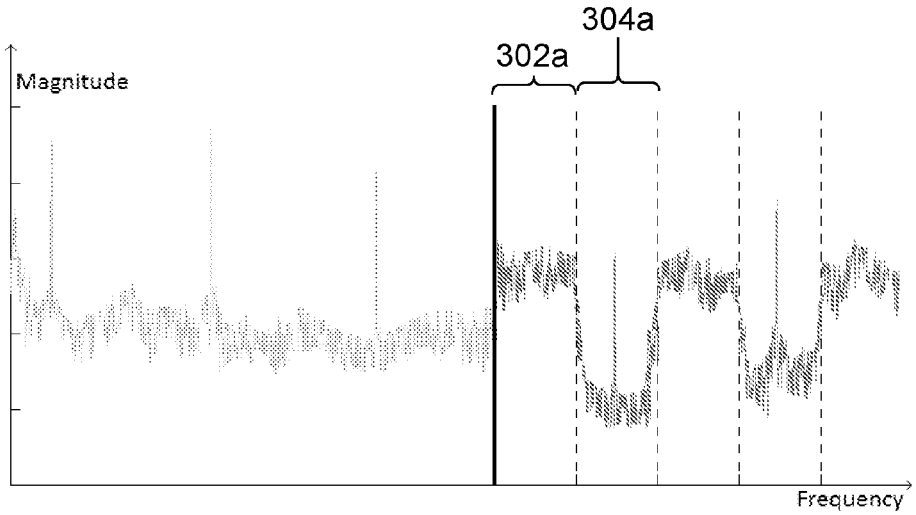
FIG. 3*a* shows the BWE spectrum (also shown in FIG. 2) scaled with corresponding BWE band gains $\hat{G}_b$, as received by the decoder. The BWE part of the spectrum is severely distorted.

FIG. 3*a* could be studied for a better understanding of the problem of mismatch between gain values and peak positions in a bandwidth extended part of a spectrum. In band 302*a*, the original spectrum comprises a peak, but the recreated BWE spectrum does not comprise a peak. This can be seen in band 202 in FIG. 2. Thus, when the gain, which is calculated for the original band comprising a peak, is applied to the BWE band, which does not comprise a peak, the low-energy spectral coefficients in the BWE band are amplified, as can be seen in band 302*a*.

Band 304*a* in FIG. 3*a*, represents the opposite situation, i.e. that the corresponding band of the original spectrum does not comprise a peak, but the corresponding band of the recreated BWE spectrum comprises a peak. Thus, the obtained gain for the band (received from the encoder) is calculated for a low-energy band. When this gain is applied to a corresponding band, which comprises a peak, the result becomes an attenuated peak, as can be seen in band 304*a* in FIG. 3*a*. From a perceptual or psychoacoustical point of view, the situation shown in band 302*a* is worse for a listener than the situation in band 304*a* for various reasons. That is, simply described; it is typically more unpleasant for a listener to experience an abnormal presence of a sound component than an abnormal absence of a sound component.

Below, an example of a novel BWE algorithm will be described, illustrating the herein described concept.

Let Y(k) denote the set of transform coefficients in the BWE region (high-frequency transform coefficients). These transform coefficients are grouped into B bands $\{Y_b\}_{b=1}^{B}$. The band size $M_b$ can be constant, or increasing towards the high-frequencies. As an example, if bands are eight dimensional and uniform (that is all $M_b=8$) we get: $Y_1=\{Y(1) \ldots Y(8)\}$, $Y_2=\{Y(9) \ldots Y(16)\}$, etc.

The first step in the BWE algorithm is to calculate gains for all bands:

$$G_b = \sqrt{\frac{Y_b^T Y_b}{M_b}} \tag{1}$$

These gains are quantized $\hat{G}_b=Q(G_b)$ and transmitted to the decoder.

The second step (which is optional) in the BWE algorithm is to calculate a noise-mix parameter or coefficient α, which is a function of e.g. the average peak energy $\overline{E}_p$ and average noise-floor energy $\overline{E}_{nf}$ of the BWE spectra, as:

$$\alpha = f\left(\frac{\overline{E}_{nf}}{\overline{E}_p}\right) \tag{2}$$

Herein, the parameter α has been derived according to (3) below. However, the exact expression used may be selected in different ways, e.g. depending on what is suitable for the type of codec or quantizer to be used, etc.

$$\alpha = \left(10\frac{\overline{E}_{nf}}{\overline{E}_p}\right)^3 \tag{3}$$

The peak and noise-floor energies can be calculated e.g. by tracking of the respective max and min spectrum energy.

The noise-mix parameter α may be quantized using a low number of bits. Herein, as an example, α is quantized with 2 bits. When the noise-mix parameter α is quantized, a parameter $\hat{\alpha}$ is obtained, i.e. $\hat{\alpha}=Q(\alpha)$ The parameter $\hat{\alpha}$ is transmitted to the decoder. The BWE region can be split into two or more sections 's', and a noise-mix parameter $\alpha_s$ could be calculated, independently, in each of these sections. In such a case, the encoder would transmit a set of noise-mix parameters to the decoder, e.g. one per section.

Decoder Operations:

The decoder extracts, from a bit-stream, the set of calculated quantized gains $\hat{G}_b$ (one for each band) and one or more quantized noise-mix parameters or factors $\hat{\alpha}$. The decoder also receives the quantized transform coefficients for the low-frequency part of the spectrum, i.e. the part of the spectrum (of the harmonic audio signal) that was encoded, as opposed to the high-frequency part, which is to be bandwidth extended.

Let $\hat{X}_b$ be a set of energy-normalized, quantized low-frequency coefficients. These coefficients are then mixed with noise, e.g. pre-generated noise stored e.g. in a noise codebook $N_b$. Using pre-generated, pre-stored noise gives an opportunity to ensure the quality of the noise, i.e. that it does not comprise any unintentional discrepancies or deviations. However, the noise could alternatively be generated "on the fly", when needed. The coefficients $\hat{X}_b$ could be mixed with the noise in the noise codebook $N_b$ e.g. as follows:

$$\hat{X}_b^{mod}=(1-\hat{\alpha})\hat{X}_b+\hat{\alpha}N_b \tag{4}$$

The range for the noise-mix parameter or factor could be set in different ways. For example, herein, the range for the noise-mix factor has been set to $\alpha\epsilon[0,0.4)$. This range means e.g. that in certain cases the noise contribution is completely ignored (α=0), and in certain cases the noise codebook contributes with 40% in the mixed vector (α=0.4), which is the maximum contribution when this range is used. The reason for introducing this kind of noise mix, where the resulting vector contains e.g. between 60% and 100% of the original low-band structure, is that the high-frequency part of the spectrum is typically noisier that the low-frequency part of the spectrum. Therefore, the noise-mix operation described above creates a vector that better resembles the statistical properties of the high-frequency part of the spectrum of the original signal, as compared to a BWE high-frequency spectrum region consisting of a flipped or translated low-frequency spectrum region. The noise mix operation can be performed independently on different parts of the BWE region, e.g. if multiple noise-mix factors (α) are provided and received.

In prior art solutions, the set of received quantized gains $\hat{G}_b$ is used directly on the corresponding bands in the BWE region. However, according to the solution described herein, these received quantized gains $\hat{G}_b$ are first modified, e,g, when appropriate, based on information about the BWE spectrum peak positions. The required information about the positions of the peaks can be extracted from the low-frequency region information in the bit-stream, or be estimated by a peak picking algorithm on the quantized transform coefficients for the low-band (or the derived coefficients of the BWE band). The information about the peaks in the low-frequency region may then be translated to the high-frequency (BWE) region. That is, when the high-band (BWE) signal is derived from the low-band signal, the algorithm can register in which bands (of the BWE region) the spectral peaks are located.

For example, a flag $f_p(b)$ may be used to indicate whether the low-frequency coefficients moved (flipped or translated) to band b in the BWE region contains peaks. For example, $f_p(b)=1$ could indicate that the band b contains at least one peak, and $f_p(b)=0$ could indicate that the band b does not contain any peak. As previously mentioned, each band b in the BWE region is associated with a gain $\hat{G}_b$, which depends on the number and size of peaks comprised in a corresponding band of the original signal. In order to match the gain to the actual peak contents of each band in the BWE region, the gain should be adapted. The gain modification is done for each band e.g. according to the following expression:

$$\hat{G}_b^{mod} = \begin{cases} \frac{1}{3}\left(\hat{G}_{b-1} + \hat{G}_b + \hat{G}_{b+1}\right) & \text{if } f_p(b) = 1 \\ \min\left\{\hat{G}_{b-1}, \hat{G}_b, \hat{G}_{b+1}\right\} & \text{if } f_p(b) = 0 \end{cases} \tag{5a}$$

Motivation for this gain modification is as follows: in case the (BWE) band contains a peak ($f_p(b)=1$), in order to avoid that the peak is attenuated in case the corresponding gain comes from a band (of the original signal) without any peaks, the gain for this band is modified to be a weighted sum of the gains for the current band and for the two neighboring bands. In the exemplifying equation (5a) above, the weights are equal, i.e. ⅓, which leads to that the modified gain is the mean value of the gain for the current band and the gains for the two neighboring bands. An alternative gain modification could be achieved according e.g. to the following:

$$\hat{G}_b^{mod} = \begin{cases} (0.1\hat{G}_{b-1} + 0.8\hat{G}_b + 0.1\hat{G}_{b+1}) & \text{if } f_p(b) = 1 \\ \min\{\hat{G}_{b-1}, \hat{G}_b, \hat{G}_{b+1}\} & \text{if } f_p(b) = 0 \end{cases} \quad (5b)$$

In case the band does not contain a peak ($f_p(b)=0$), we do not want to amplify the noise-like structure in this band by applying a strong gain that is calculated from an original signal band that contained one or more peaks. To avoid this, the gain for this band is selected to be e.g. the minimum of the gain of the current band and the gains of the two neighboring bands. The gain for a band comprising a peak could alternatively be selected or calculated as a weighted sum, such as e.g. the mean, of more than 3 bands, e.g. 5 or 7 bands, or be selected as the median value of e.g. 3, 5 or 7 bands. By using a weighted sum, such as a mean or median value, the peak will most likely be slightly attenuated, as compared to when using a "true" gain. However, an attenuation as compared to the "true" gain may be beneficial, as compared to the opposite, since moderate attenuation is better, from perceptual point of view, as compared to amplification resulting in an exaggerated audio component, as previously mentioned.

The cause for the peak-mismatch, and thus the reason for the gain modification, is that spectral bands are placed on a pre-defined grid, but peak positions and peaks (after flipping or translating low-frequency coefficients), vary over time. This might cause peaks to go in or out of a band in an uncontrolled way. Thus, the peak positions in the BWE part of the spectrum does not necessarily match the peak positions in the original signal, and thus, there may be a mismatch between the gain associated with a band and the peak contents of the band. Example of scaling with unmodified gains is presented in FIG. 3*a*, and scaling with modified gains in FIG. 3*b*.

Figure 3B:
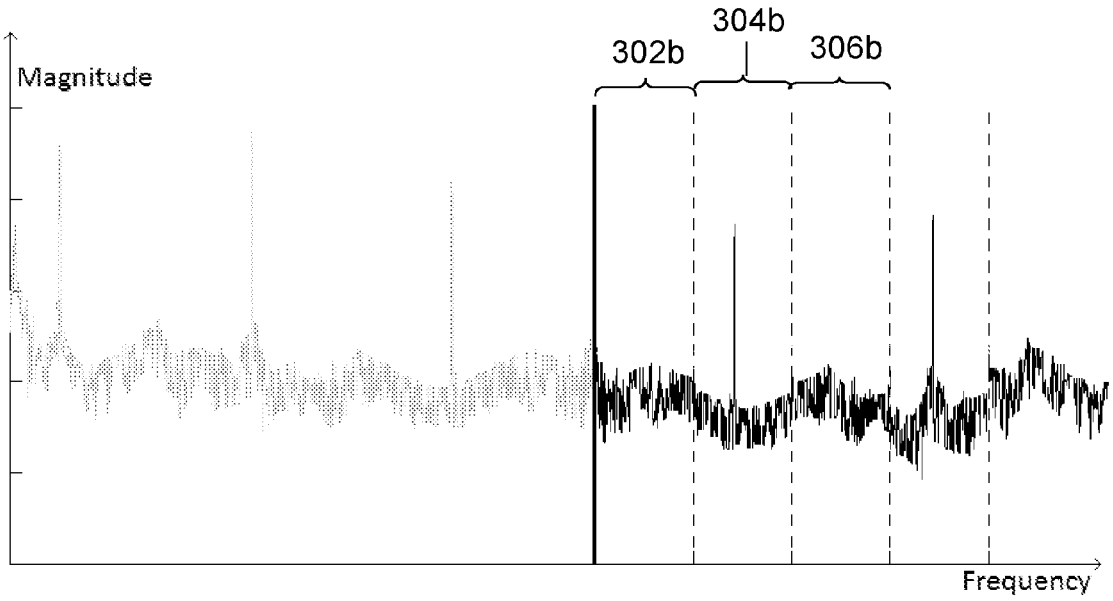
FIG. 3*b* shows the BWE spectrum scaled with modified BWE band gains $\hat{G}_b^{mod}$, as suggested herein. In this case, the BWE part of the spectrum gets the desired shape.

The result of using modified gains as suggested herein can be seen in FIG. 3*b*. In band 302*b*, the low-energy spectral coefficients are no longer as amplified as in band 302*a* of FIG. 3*a*, but are scaled with a more appropriate band gain. Further, the peak in band 304*b* is no longer as attenuated as the peak in band 304*a* of FIG. 3*a*. The spectrum illustrated in FIG. 3*b* most likely corresponds to an audio signal which is more agreeable to a listener than an audio signal corresponding to the spectrum of FIG. 3*a*.

Thus, the BWE algorithm may create the high-frequency part of the spectrum. Since (e.g. for bandwidth saving reasons), the set of high-frequency coefficients $Y_b$ are not available at the decoder, the high-frequency transform coefficients $\tilde{Y}_b$ are instead reconstructed and formed by scaling the flipped (or translated) low-frequency coefficients (possibly after noise-mix) with the modified quantized gains $$\tilde{Y}_b = \hat{G}_b^{mod} \hat{X}_b^{mod} \quad (6)$$

This set of transform coefficients $\tilde{Y}_b$ are used to reconstruct the high-frequency part of the audio signal's waveform.

The solution described herein is an improvement to the BWE concept, commonly used in transform domain audio coding. The presented algorithm preserves the peaky structure (peak to noise-floor ratio) in the BWE region, thus providing improved audio quality of the reconstructed signal.

The term "transform audio codec" or "transform codec" embraces an encoder-decoder pair, and is the term which is commonly used in the field. Within this disclosure, the terms "transform audio encoder" or "encoder" and "transform audio decoder" or "decoder" are used, in order to separately describe the functions/parts of a transform codec. The terms "transform audio encoder"/"encoder" and "transform audio decoder"/"decoder" could thus be exchanged for the term "transform audio codec" or "transform codec".

Figure 4A:
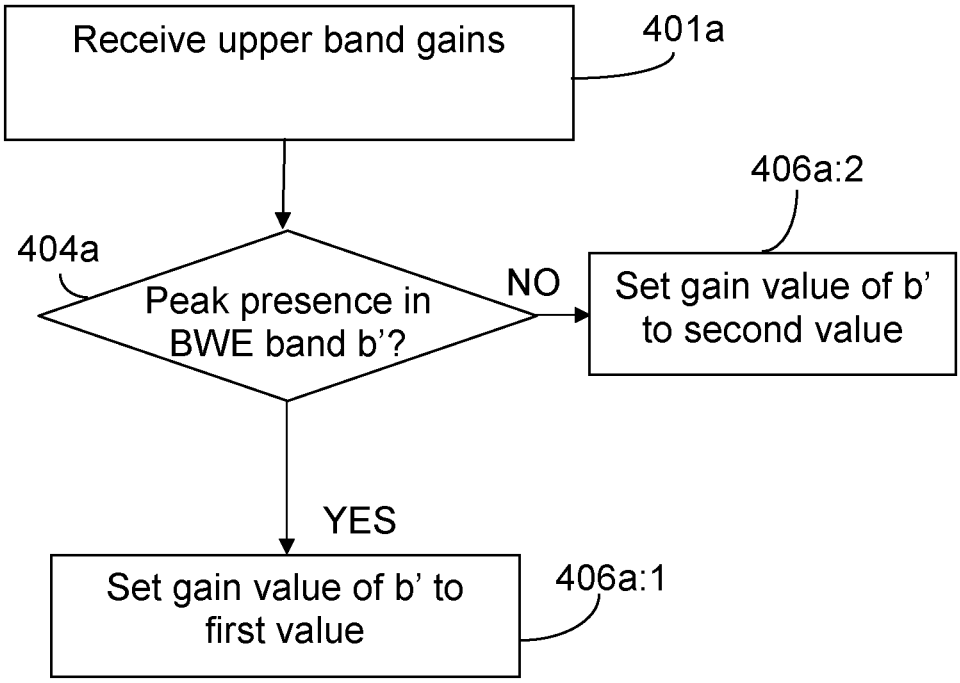
FIGS. 4*a* and 4*b* are flow charts illustrating the actions in a procedure in a transform audio decoder, according to exemplifying embodiments.
Figure 4B:
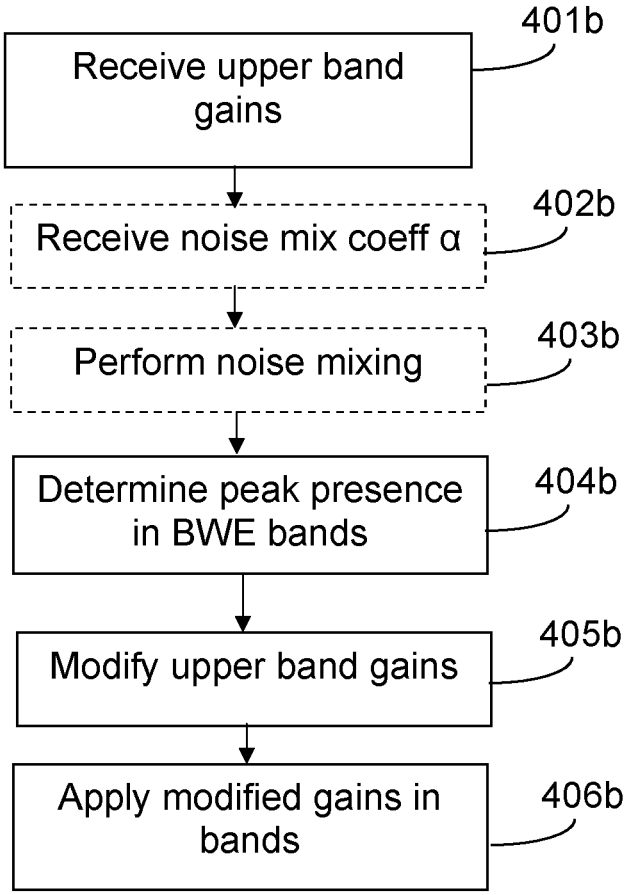

Exemplifying Procedures in Decoder, FIGS. 4*a* and 4*b*

An exemplifying procedure, in a decoder, for supporting bandwidth extension, BWE, of a harmonic audio signal will be described below, with reference to FIG. 4*a*. The procedure is suitable for use in a transform audio encoder, such as e.g. an MDCT encoder, or other encoder. The audio signal is primarily thought to comprise music, but could also or alternatively comprise e.g. speech.

A gain value associated with a frequency band b (original frequency band) and gain values associated with a number of other frequency bands, adjacent to frequency band b, are received in an action 401*a*. Then, it is determined in an action 404*a* whether a reconstructed corresponding frequency band b' of a BWE region comprises a spectral peak or not. When the reconstructed frequency band b' comprises at least one spectral peak, a gain value associated with the reconstructed frequency band b' is set to a first value, in an action 406*a*:1, based on the received plurality of gain values. When the reconstructed frequency band b' does not comprise any spectral peak, a gain value associated with the reconstructed frequency band b' is set to a second value, in an action 406*a*:2, based on the received plurality of gain values. The second value is lower than or equal to the first value.

In FIG. 4*b*, the procedure illustrated in FIG. 4*a* is illustrated in a slightly different and more extended manner, e.g. with additional optional actions related to the previously described noise mixing. FIG. 4*b* will be described below.

Gain values associated with the bands of the upper part of the frequency spectrum are received in action 401*b*. Information related to the lower part of the frequency spectrum, i.e. transform coefficients and gain values, etc., is also assumed to be received at some point (not shown in FIG. 4*a* or 4*b*). Further, it is assumed that a bandwidth extension is performed at some point, where a high-band spectrum is created by flipping or translating the low-band spectrum as previously described.

One or more noise mix coefficients may be received in an optional action 402*b*. The received one or more noise mix coefficients have been calculated in the encoder based on the energy distribution in the original high-band spectrum. The noise mix coefficients may then be used for mixing the coefficients in the high band region with noise, cf. equation (4) above, in an (also optional) action 403*b*. Thus, the spectrum of the bandwidth extended region will correspond better to the original high-band spectrum in regard of "noisiness" or noise contents.

Further, it is determined in an action 404*b*, whether the bands of the created BWE region comprises a peak or not. For example, if a band comprises a peak, an indicator associated with the band may be set to 1. If another band does not comprise a peak, an indicator associated with that band may be set to 0. Based on the information of whether a band comprises a peak or not, the gain associated with said band may be modified in an action 405*b*. When modifying the gain for a band, the gains for adjacent bands are taken into account in order to reach the desired result, as previously described. By modifying the gains in this way, the achieving of an improved BWE spectrum is enabled. The modified gains may then be applied to the respective bands of the BWE spectrum, which is illustrated as action 406*b*.

Exemplifying Decoder

Below, an exemplifying transform audio decoder, adapted to perform the above described procedure for supporting bandwidth extension, BWE, of a harmonic audio signal will be described with reference to FIG. 5. The transform audio decoder could e.g. be an MDCT decoder, or other decoder, The transform audio decoder 501 is illustrated as to communicate with other entities via a communication unit 502. The part of the transform audio decoder which is adapted for enabling the performance of the above described procedure is illustrated as an arrangement 500, surrounded by a broken line. The transform audio decoder may further comprise other functional units 516, such as e.g. functional units providing regular decoder and BWE functions, and may further comprise one or more storage units 514.

The transform audio decoder 501, and/or the arrangement 500, could be implemented e.g. by one or more of: a processor or a micro processor and adequate software with suitable storage therefore, a Programmable Logic Device (PLD) or other electronic component(s).

The transform audio decoder is assumed to comprise functional units for obtaining the adequate parameters provided from an encoding entity. The noise-mix coefficient is a new parameter to obtain, as compared to the prior art. Thus, the decoder should be adapted such that one or more noise-mix coefficients may be obtained when this feature is desired. The audio decoder may be described and implemented as comprising a receiving unit, adapted to receive a plurality of gain values associated with a frequency band b and a number of adjacent frequency bands of band b; and possibly a noise-mix coefficient. Such a receiving unit is, however, not explicitly shown in FIG. 5.

The transform audio decoder comprises a determining unit, alternatively denoted peak detection unit, 504, which is adapted to determine and indicate which bands of a BWE spectrum region that comprise a peak and which bands that do not comprise a peak. That is the determining unit is adapted to determine whether a reconstructed corresponding frequency band b' of a bandwidth extended frequency region comprises a spectral peak. Further, the transform audio decoder may comprise a gain modification unit 506, which is adapted to modify the gain associated with a band depending on if the band comprises a peak or not. If the band comprises a peak, the modified gain is calculated as a weighted sum, e.g. a mean or median value of the (original) gains of a plurality of bands adjacent to the band in question, including the gain of the band in question.

The transform audio decoder may further comprise a gain applying unit 508, adapted to apply or set the modified gains to the appropriate bands of the BWE spectrum. That is, the gain applying unit is adapted to set a gain value associated with the reconstructed frequency band b' to a first value based on the received plurality of gain values when the reconstructed frequency band b' comprises at least one spectral peak, and to set a gain value associated with the reconstructed frequency band b' to a second value based on the received plurality of gain values when the reconstructed frequency band b' does not comprise any spectral peak, where the second value is lower than or equal to the first value. Thus, bringing gain values into agreement with peak positions in the bandwidth extended frequency region is enabled.

Alternatively, if possible without modification, the applying function may be provided by the (regular) further functionality 516, only that the applied gains are not the original gains, but the modified gains. Further, the transform audio decoder may comprise a noise mixing unit 510, adapted to mix the coefficients of the BWE part of the spectrum with noise, e.g. from a code book, based on one or more noise coefficients or parameters provided by the encoder of the audio signal.

Exemplifying Procedure Encoder

Figure 6:
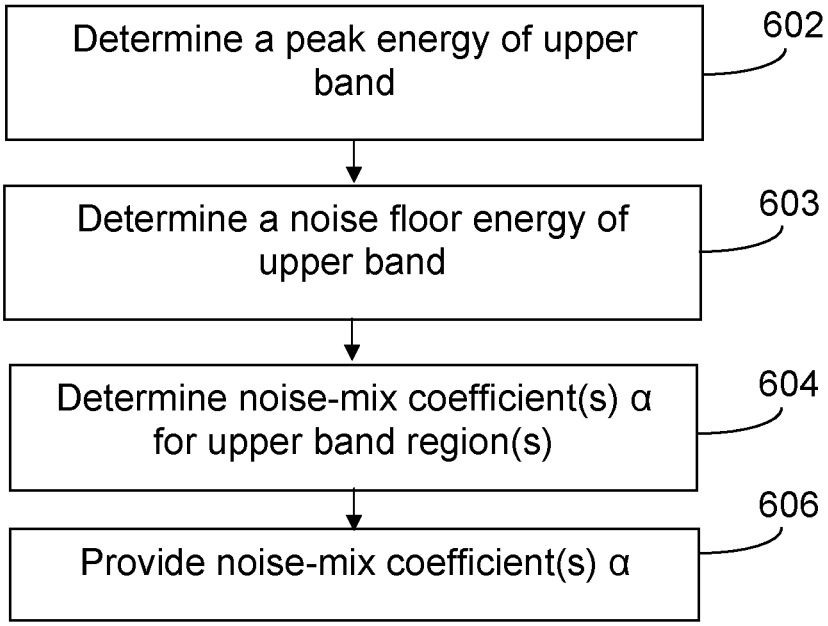
FIG. 6 is a flow chart illustrating actions in a procedure in a transform audio encoder, according to an exemplifying embodiment.

An exemplifying procedure, in an encoder, for supporting bandwidth extension, BWE, of a harmonic audio signal will be described below, with reference to FIG. 6. The procedure is suitable for use in a transform audio encoder, such as e.g. an MDCT encoder, or other encoder. As previously mentioned, the audio signal is primarily thought to comprise music, but could also or alternatively comprise e.g. speech.

The procedure described below relates to the parts of an encoding procedure which deviates from a conventional encoding of a harmonic audio signal using a transform encoder. Thus, the actions described below are an optional addition to the deriving of transform coefficients and gains, etc., for the lower part of the spectrum and the deriving of gains for the bands of the higher part of the spectrum (the part which will be constructed by BWE on the decoder side)

Peak energy related to the upper part of the frequency spectrum is determined in an action 602. Further, a noise floor energy related to the upper part of the frequency spectrum is determined in an action 603. For example, the average peak energy $\overline{E}_p$ and average noise-floor energy $\overline{E}_{nf}$ of one or more sections of the BWE spectra could be calculated, as described above. Further, noise-mix coefficients are calculated in an action 604, according to some suitable formula, e.g. equation (3) above, such that the noise coefficient related to a certain section of the BWE spectrum reflects the amount of noise, or "noisiness" of said section. The one or more noise-mix coefficients are provided, in an action 606, to a decoding entity or to a storage along with the conventional information provided by the encoder. The providing may comprise e.g. simply outputting the calculated noise-mix coefficients to an output, and/or e.g. transmitting the coefficients to a decoder. The noise-mix coefficients could be quantized before being provided, as previously described.

Exemplifying Encoder

Below, an exemplifying transform audio decoder, adapted to perform the above described procedure for supporting bandwidth extension, BWE, of a harmonic audio signal will be described with reference to FIG. 7. The transform audio decoder could e.g. be an MDCT decoder, or other decoder.

The transform audio decoder 701 is illustrated as to communicate with other entities via a communication unit 702. The part of the transform audio decoder which is adapted for enabling the performance of the above described procedure is illustrated as an arrangement 700, surrounded by a dashed line. The transform audio decoder may further comprise other functional units 712, such as e.g. functional units providing regular encoder functions, and may further comprise one or more storage units 710.

The transform audio encoder 701, and/or the arrangement 700, could be implemented e.g. by one or more of: a processor or a micro processor and adequate software with suitable storage therefore, a Programmable Logic Device (PLD) or other electronic component(s).

The transform audio encoder may comprise a determining unit 704, which is adapted to determine peak energies and noise-floor energy of the upper part of the spectrum. Further, the transform audio encoder may comprise a noise coefficient unit 706, which is adapted to calculate one or more noise-mix coefficients for the whole upper part of the spectrum or sections thereof. The transform audio encoder may further comprise a providing unit 708, adapted to provide the calculated noise-mix coefficients for use by an encoder. The providing may comprise e.g. simply outputting the calculated noise-mix coefficients to an output, and/or e.g. transmitting the coefficients to a decoder.

Exemplifying Arrangement

Figure 5:
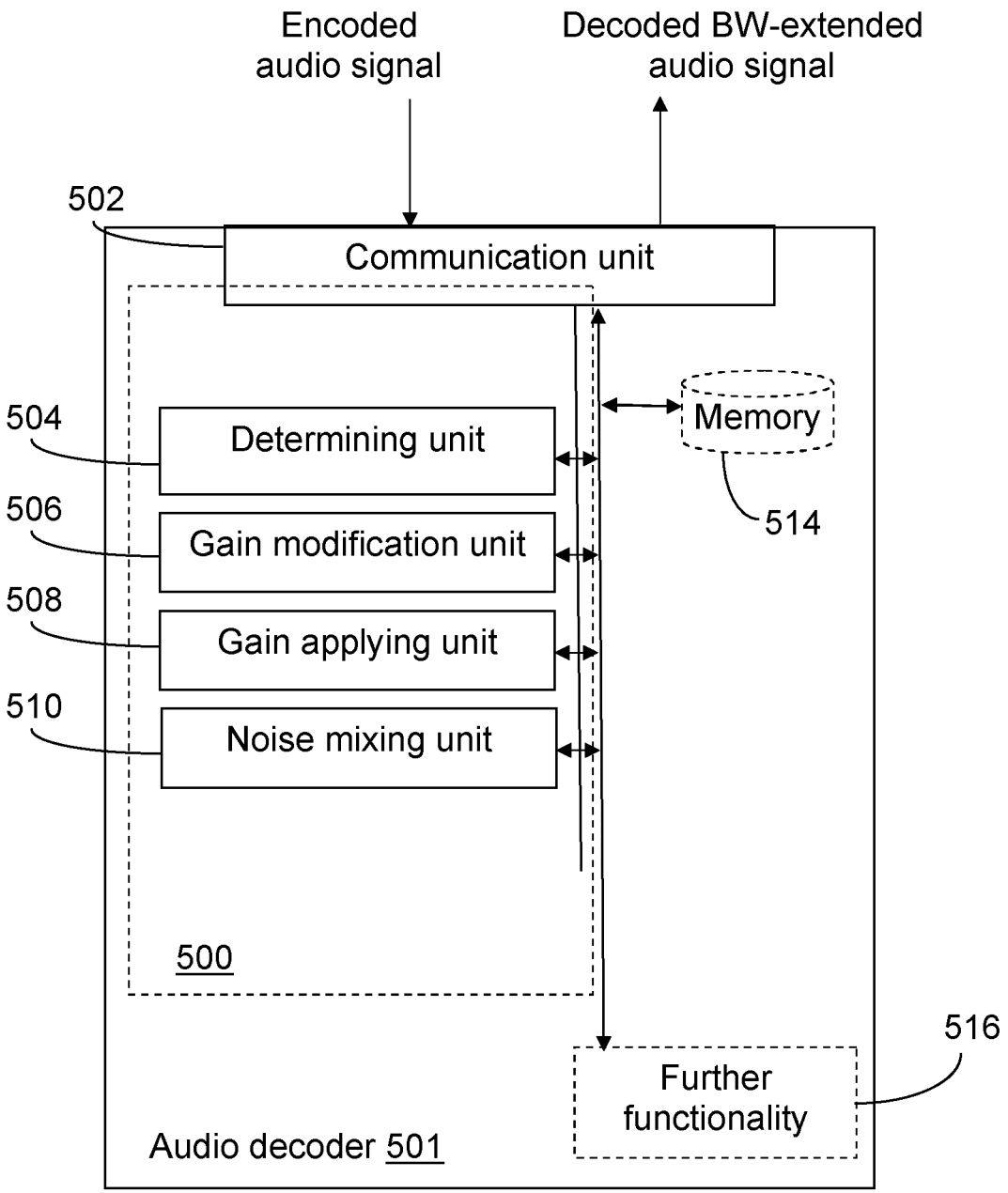
FIG. 5 is a block diagram illustrating a transform audio decoder, according to an exemplifying embodiment.
Figure 8:
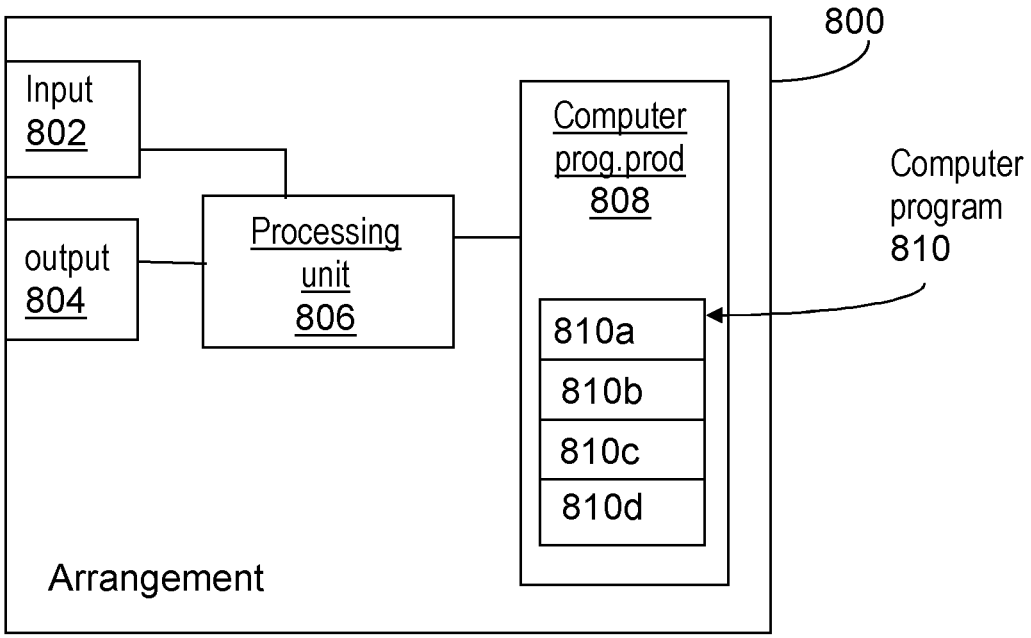
FIG. 8 is a block diagram illustrating an arrangement in a transform audio decoder, according to an exemplifying embodiment.

FIG. 8 schematically shows an embodiment of an arrangement 800 suitable for use in a transform audio decoder, which also can be an alternative way of disclosing an embodiment of the arrangement for use in a transform audio decoder illustrated in FIG. 5. Comprised in the arrangement 800 are here a processing unit 806, e.g. with a DSP (Digital Signal Processor). The processing unit 806 can be a single unit or a plurality of units to perform different steps of procedures described herein. The arrangement 800 may also comprise the input unit 802 for receiving signals, such as a the encoded lower part of the spectrum, gains for the whole spectrum and noise-mix coefficient(s) (cf. if encoder: upper part of the harmonic spectrum), and the output unit 804 for output signal(s), such as a the modified gains and/or the complete spectrum (cf. if encoder: the noise-mix coefficients). The input unit 802 and the output unit 804 may be arranged as one in the hardware of the arrangement.

Furthermore the arrangement 800 comprises at least one computer program product 808 in the form of a non-volatile or volatile memory, e.g. an EEPROM, a flash memory and a hard drive. The computer program product 808 comprises a computer program 810, which comprises code means, which when run in the processing unit 806 in the arrangement 800 causes the arrangement and/or the transform audio encoder to perform the actions of the procedure described earlier in conjunction with FIG. 4.

Hence, in the exemplifying embodiments described, the code means in the computer program 810 of the arrangement 800 may comprise an obtaining module 810*a* for obtaining information related to a lower part of an audio spectrum, and gains related to the whole audio spectrum. Further, noise-coefficients related to the upper part of the audio spectrum may be obtained. The computer program may comprise a detection module 810*b* for detecting and indicating whether bands of the reconstructed bands b of a bandwidth extended frequency region comprises a spectral peak or not. The computer program 810 may further comprise a gain modification module 810*c* for modifying the gain associated with the bands of the upper, reconstructed, part of the spectrum. The computer program 810 may further comprise a gain applying module 810*d* for applying the modified gains to the corresponding bands of the upper part of the spectrum. Further, the computer program 810 may comprise a noise mixing module 810*d*, for mixing the upper part of the spectrum with noise based on received noise-mix coefficients.

The computer program 810 is in the form of computer program code structured in computer program modules. The modules 810*a-d* essentially perform the actions of the flow illustrated in FIG. 4*a* or 4*b* to emulate the arrangement 500 illustrated in FIG. 5. In other words, when the different modules 810*a-d* are run on the processing unit 806, they correspond at least to the units 504-510 of FIG. 5.

Although the code means in the embodiment disclosed above in conjunction with FIG. 8 are implemented as computer program modules which when run on the processing unit causes the arrangement and/or transform audio encoder to perform steps described above in the conjunction with figures mentioned above, at least one of the code means may in alternative embodiments be implemented at least partly as hardware circuits.

Figure 7:
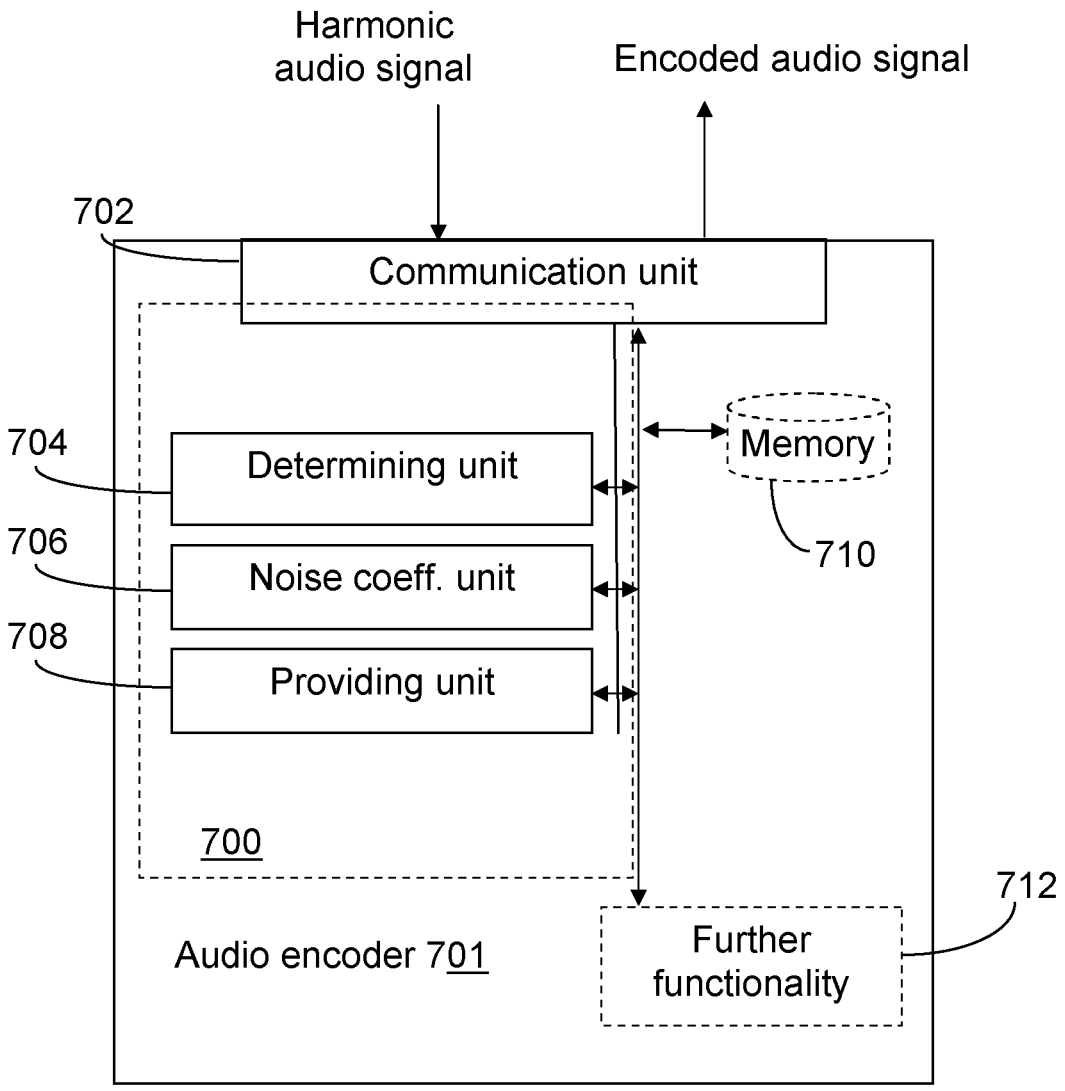
FIG. 7 is a block diagram illustrating a transform audio encoder, according to an exemplifying embodiment.

In a similar manner, an exemplifying embodiment comprising computer program modules could be described for the corresponding arrangement in a transform audio encoder illustrated in FIG. 7.

While the suggested technology has been described with reference to specific example embodiments, the description is in general only intended to illustrate the concept and should not be taken as limiting the scope of the solution described herein. The different features of the exemplifying embodiments above may be combined in different ways according to need, requirements or preference.

The solution described above may be used wherever audio codecs are applied, e.g. in devices such as mobile terminals, tablets, computers, smart phones, etc.

It is to be understood that the choice of interacting units or modules, as well as the naming of the units are only for exemplifying purpose, and nodes suitable to execute any of the methods described above may be configured in a plurality of alternative ways in order to be able to execute the suggested process actions.

It should also be noted that the units or modules described in this disclosure are to be regarded as logical entities and not with necessity as separate physical entities. Although the description above contains many specific terms, these should not be construed as limiting the scope of this disclosure, but as merely providing illustrations of some of the presently preferred embodiments of the technology suggested herein. It will be appreciated that the scope of the technology suggested herein fully encompasses other embodiments which may become obvious to those skilled in the art, and that the scope of this disclosure is accordingly not to be limited. Reference to an element in the singular is not intended to mean "one and only one" unless explicitly so stated, but rather "one or more." All structural and functional equivalents to the elements of the above-described embodiments that are known to those of ordinary skill in the art are expressly incorporated herein by reference and are intended to be encompassed hereby. Moreover, it is not necessary for a device or method to address each and every problem sought to be solved by the technology suggested herein, for it to be encompassed hereby.

In the preceding description, for purposes of explanation and not limitation, specific details are set forth such as particular architectures, interfaces, techniques, etc. in order to provide a thorough understanding of the suggested technology. However, it will be apparent to those skilled in the art that the suggested technology may be practiced in other embodiments that depart from these specific details. That is, those skilled in the art will be able to devise various arrangements which, although not explicitly described or shown herein, embody the principles of the suggested technology. In some instances, detailed descriptions of well-known devices, circuits, and methods are omitted so as not to obscure the description of the suggested technology with unnecessary detail. All statements herein reciting principles, aspects, and embodiments of the suggested technology, as well as specific examples thereof, are intended to encompass both structural and functional equivalents thereof. Additionally, it is intended that such equivalents include both currently known equivalents as well as equivalents developed in the future, e.g., any elements developed that perform the same function, regardless of structure.

Thus, for example, it will be appreciated by those skilled in the art that block diagrams herein can represent conceptual views of illustrative circuitry or other functional units embodying the principles of the technology. Similarly, it will be appreciated that any flow charts, state transition diagrams, pseudo code, and the like represent various processes which may be substantially represented in computer readable medium and so executed by a computer or processor, whether or not such computer or processor is explicitly shown.

The functions of the various elements including functional blocks, including but not limited to those labeled or described as "functional unit", "processor" or "controller", may be provided through the use of hardware such as circuit hardware and/or hardware capable of executing software in the form of coded instructions stored on computer readable medium. Thus, such functions and illustrated functional blocks are to be understood as being either hardware-implemented and/or computer-implemented, and thus machine-implemented.

In terms of hardware implementation, the functional blocks may include or encompass, without limitation, digital signal processor (DSP) hardware, reduced instruction set processor, hardware (e.g., digital or analog) circuitry including but not limited to application specific integrated circuit(s) (ASIC), and (where appropriate) state machines capable of performing such functions.

Abbreviations

BWE Bandwidth Extension

DFT Discrete Fourier Transform

DCT Discrete Cosine Transform

MDCT Modified Discrete Cosine Transform

The invention claimed is:

1. A method performed by a transform audio decoder for supporting bandwidth extension, BWE, of a harmonic audio signal, the method comprising:

receiving, through a communication circuit, the harmonic audio signal and a plurality of gain values associated with a frequency band b and a number of adjacent frequency bands of band b;

determining, by the transform audio decoder, whether a reconstructed corresponding frequency band b' of a bandwidth extended frequency region of the harmonic audio signal comprises at least one spectral peak, and when the reconstructed frequency band b' comprises at least one spectral peak:

setting, by the transform audio decoder, a gain value associated with the reconstructed frequency band b' to a first value based on the received plurality of gain values; wherein the first value is a weighted sum of the received plurality of gain values, and when the reconstructed frequency band b' does not comprise any spectral peak:

setting, by the transform audio decoder, the gain value associated with the reconstructed frequency band b' to a second value based on the received plurality of gain values, wherein the second value is lower than or equal to the first value, thus enabling bringing gain values into agreement with peak positions in the bandwidth extended frequency region of the harmonic audio signal to generate, by the transform audio decoder, a bandwidth-extended audio signal, and transmitting, through the communication circuit, the bandwidth-extended audio signal.

2. The method according to claim 1, wherein the weighted sum is a mean value of the received plurality of gain values.

3. The method according to claim 1, wherein the second value is one of the lowest gain values amongst the received plurality of gain values.

4. The method according to claim 1, wherein the second value is the minimum gain value of the received plurality of gain values.

5. The method according to claim 1, further comprising:

receiving a coefficient a reflecting a relation between the peak energy and the noise-floor energy of at least a section of the high frequency part of the original signal; and mixing transform coefficients of a corresponding reconstructed high frequency section with noise, based on the received coefficient $\alpha$, thus enabling reconstruction of noise characteristics of the high frequency part of the original signal.

6. An audio decoder for supporting bandwidth extension, BWE, of a harmonic audio signal, the audio decoder comprising:

a receiving unit, adapted to receive the harmonic audio signal and a plurality of gain values associated with a frequency band b and a number of adjacent frequency bands of band b;

a determining unit, adapted to determine whether a reconstructed corresponding frequency band b' of a bandwidth extended frequency region of the harmonic audio signal comprises at least one spectral peak; and a gain applying unit, adapted to:

set a gain value associated with the reconstructed frequency band b' to a first value based on the received plurality of gain values, such that the first value is a weighted sum of the received plurality of gain values, when the reconstructed frequency band b' comprises at least one spectral peak, and set the gain value associated with the reconstructed frequency band b' to a second value based on the received plurality of gain values when the reconstructed frequency band b' does not comprise any spectral peak, wherein the second value is lower than or equal to the first value, thus enabling bringing gain values into agreement with peak positions in the bandwidth extended frequency region of the harmonic audio signal to generate a bandwidth-extended audio signal, and a communication circuit, adapted to transmit the bandwidth-extended audio signal.

7. The audio decoder according to claim 6, wherein the weighted sum is a mean value of the received plurality of gain values.

8. The audio decoder according to claim 6, wherein the second value is one of the lowest gain values amongst the received plurality of gain values.

9. The audio decoder according to claim 6, wherein the second value is the minimum gain value of the received plurality of gain values.

10. The audio decoder according to claim 6, further adapted to receive a coefficient $\alpha$ reflecting a relation between the peak energy and the noise-floor energy of at least a section of the high frequency part of the original signal; and further comprising:

a noise mixing unit, adapted to mix transform coefficients of a corresponding reconstructed high frequency section with noise, based on the received coefficient $\alpha$, thus enabling reconstruction of noise characteristics of the high frequency part of the original signal.

11. User Equipment comprising audio decoder according to claim 6.

12. A computer program product comprising a non-transitory computer readable medium storing computer readable code, which when run in a processing unit, causes an audio decoder to perform the method according to claim 1.

* * * * *